United States Patent [19]

Strauss

[11] Patent Number: 4,752,754

[45] Date of Patent: Jun. 21, 1988

[54] METHOD OF PRODUCING A REED RELAY FOR SWITCHING R.F. CURRENTS, AND REED RELAY PRODUCED IN ACCORDANCE THEREWITH

[75] Inventor: Gerhard Strauss, Langen, Fed. Rep. of Germany

[73] Assignee: Elfein Elektrofeingeratebau GmbH, Frankfurt, Fed. Rep. of Germany

[21] Appl. No.: 812,329

[22] Filed: Dec. 23, 1985

[30] Foreign Application Priority Data

Jun. 28, 1985 [DE] Fed. Rep. of Germany ..... 3523114

[51] Int. Cl.[4] ..... H01H 1/66

[52] U.S. Cl. ..... 335/151; 29/622; 335/153; 335/154

[58] Field of Search ..... 335/151-154, 335/202; 29/622

[56] References Cited

U.S. PATENT DOCUMENTS

| | | | |
|---|---|---|---|
| 3,134,867 | 5/1964 | Winship | 335/202 |
| 3,268,839 | 8/1966 | McFarland | 335/151 |
| 3,829,802 | 8/1974 | Collette | 335/154 |
| 4,225,836 | 9/1980 | DeMaesschalck et al. | 335/154 X |
| 4,408,817 | 10/1983 | Mattis | 335/202 |

FOREIGN PATENT DOCUMENTS

| | | | |
|---|---|---|---|
| 674758 | 9/1961 | Italy | 335/151 |
| 702424 | 12/1979 | U.S.S.R. | 335/151 |

*Primary Examiner*—Arthur T. Grimley
*Assistant Examiner*—Jane K. Lau
*Attorney, Agent, or Firm*—McAulay, Fields, Fisher, Goldstein & Nissen

[57] ABSTRACT

In a method for producing a reed relay, and a reed relay produced in accordance therewith, for switching r.f. currents at high voltages, it is proposed to arrange the coil, which is wound upon a normal bobbin with flanges on both sides, within a low-ohmic coil shielding by mounting the bobbin with the coil in an outer tube of brass, fitting an inner tube, likewise of brass, in the bobbin and connecting the two tubes by annular end disks placed on the two ends and joined with the tubes by pressing. The whole assembly comprising the bobbin, the coil and the shielding is then mounted on a two-piece bobbin carrier, and the vacuum glass tube of the r.f. reed switch is inserted into the bearing tube of the bobbin carrier and preferable fixed therein by means of a silicone hose.

19 Claims, 2 Drawing Sheets

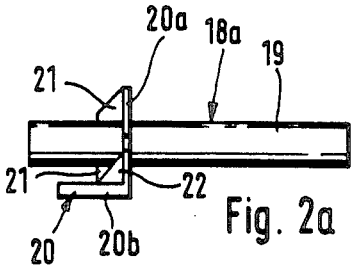
Fig. 2a
Fig. 2c
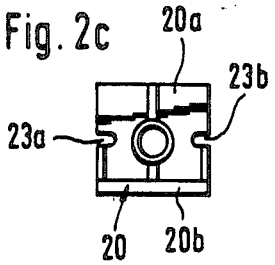
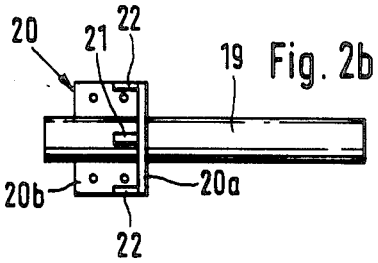
Fig. 2b
Fig. 2d
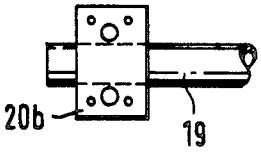
Fig. 3a
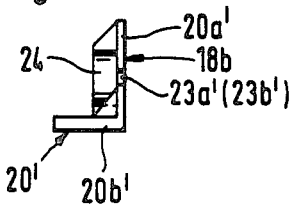
Fig. 4
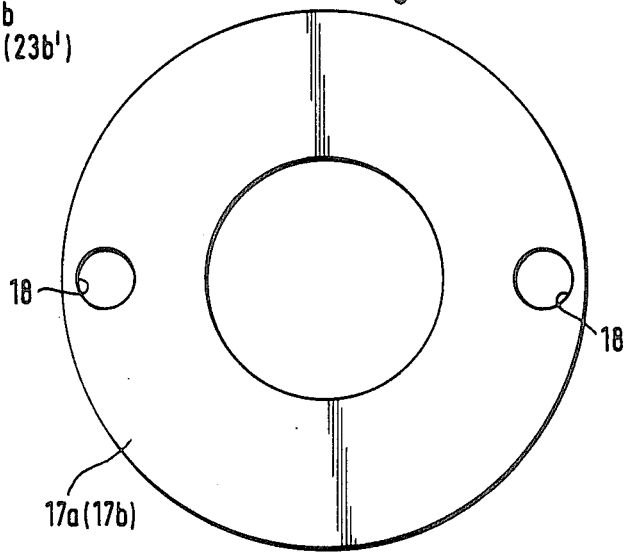
Fig. 3b
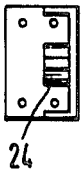

METHOD OF PRODUCING A REED RELAY FOR SWITCHING R.F. CURRENTS, AND REED RELAY PRODUCED IN ACCORDANCE THEREWITH

BACKGROUND OF THE INVENTION

The present invention relates to a reed relay and a method of making the same. It has been known heretofore to produce reed relays built up from so-called reed switches in many different ways, for example by inserting the glass tube enclosing a vacuum and a contact pair sealed therein and thus constituting a reed switch into a shrink-on hose, together with a coil winding surrounding the glass tube, and by forming from the latter, by a heating process and a clamping operation performed on both sides after hardening, the relay case which simultaneously serves to support the reed relay thus formed and to protect the glass tube.

There has been known still another method according to which the glass tube of the vacuum reed switch and the associated switching coil are introduced into a rectangular case with one open side wall, whereupon the case is hermetically sealed using a suitable synthetic resin, with the respective connection contacts projecting outwardly.

The known reed-relays therefore contain conventionally a coil support forming the coil and supporting at the same time the glass tube of the reed switch in such a manner that the contact reeds perform a movement during excitation, which means that the bobbin which is designed in one piece can act simultaneously as support for the coil and as casing for the reed switch so that it forms in this manner the entire reed relay.

Problems may, however, be encountered with the usual designs of reed relays and their production methods where such relays are intended for carrying currents or signals of particularly high frequencies (for example 30 MHz with currents of, for example, up to 5 A) or operating voltages which may, for example be in the range of $kV_{SS}$. Such unusual and, therefore, extreme operating conditions may in the case of the usual reed relays lead to disadvantages due to the effect of the strong radio-frequency electromagnetic fields which lead at least to increased temperatures in the entire area of the coil and the relay so that apart from possible variations of the electric data, the stability of the reed relay itself may also be impaired.

Now, it is the object of the present invention to provide a production process for a reed relay, and a reed relay, wherein the detrimental effects (including the effects of high frequencies/high voltages/high currents) can be avoided by providing a particularly efficient low-ohmic shielding in the coil area.

ADVANTAGES OF THE INVENTION

The production method according to the invention and the reed relay produced in accordance with this method offer the advantage that the relays according to the invention are particularly resistant to the strong influence of the radio-frequency electromagnetic fields and that their design is at the same time simple and cost-saving.

The invention starts out from the realization that, contrary to the usual forms of reed relays, a division is required in the area of the support of the coil and/or the relay in order on the one hand to implement the low-ohmic shielding of the coil and, on the other hand, to obtain a safe support for the vacuum glass tube of the reed switch and the entire reed relay.

It is a further advantage of the present invention that it provides the possibility to use (plastic) materials for the bobbin and/or the bobbin support which offer particularly favorable dielectric properties for r.f. applications but which due to their low temperature stability cannot be employed when the low-ohmic coil shielding provided by the invention is missing because the dissipated heat encountered when the coil is not sufficiently shielded would heavily impair the stability of such materials or even cause the material to melt in extreme cases.

The shielding consists of a material, usually a metallic material, which is highly conductive electrically, but not conductive magnetically, a particularly advantageous implementation of the screening consisting of brass tubes and end rings, likewise stamped from brass, which are additionally coated, preferably fire-tinned, so that a particularly low-ohmic connection is achieved when the separately mounted shielding parts are brought into intimate contact.

Such an intimate contact can be achieved by exerting a suitable pressure in a tool so that a form-locking connection is achieved which insures that all parts are in tight and intimate contact with each other so that the electric coil and the bobbin are embraced all around by a metallic enclosure and, thus, fully shielded.

BRIEF DESCRIPTION OF THE DRAWING

One embodiment of the invention is shown in the drawing and will be described hereafter.

In the drawing:

FIGS. 2*a* to 2*d* show a side view, a top view, a front view and a bottom view, respectively, of part of a bobbin carrier that has to be mounted subsequently to complete the reed relay;

FIGS. 3*a* and 3*b* show a part of the bobbin carrier completing the representation of FIGS. 2*a* to 2*d;* and FIG. 4 shows the top view of a punched ring which together with an inner and an outer brass tube forms the metallic shielding of the bobbin and winding.

DESCRIPTION OF THE EMBODIMENTS

The basic concept of the present invention consists in the idea to produce an r.f. reed relay by winding the electric coil around a separate bobbin, encasing the said bobbin in a metallic enclosure which forms a low-ohmic shielding, connecting this assembly thereafter with a split bobbin carrier which simultaneously receives and carries in an inner tube the vacuum reed switch which switches the r.f. currents (for example 30 MHz at, for example, 5A and operating voltages of, for example, 5 $kV_{ss}$).

Figure 1A:
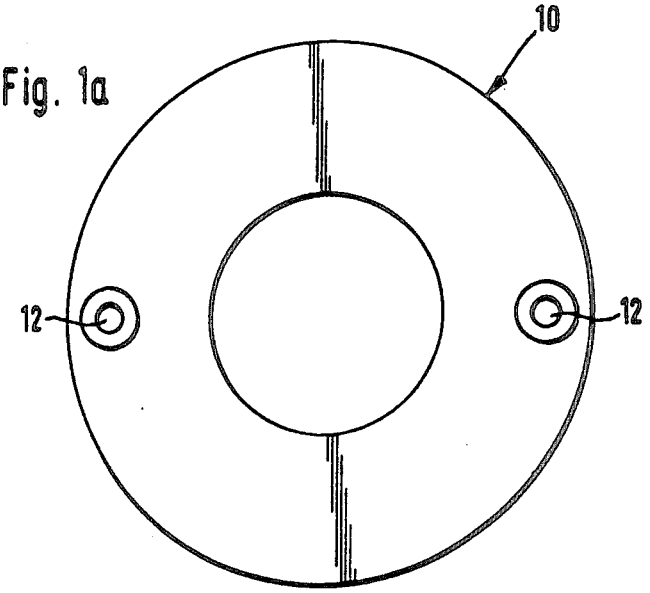
FIG. 1*a* is a front view of the representation of FIG. 1 showing only the coil.
Figure 1:
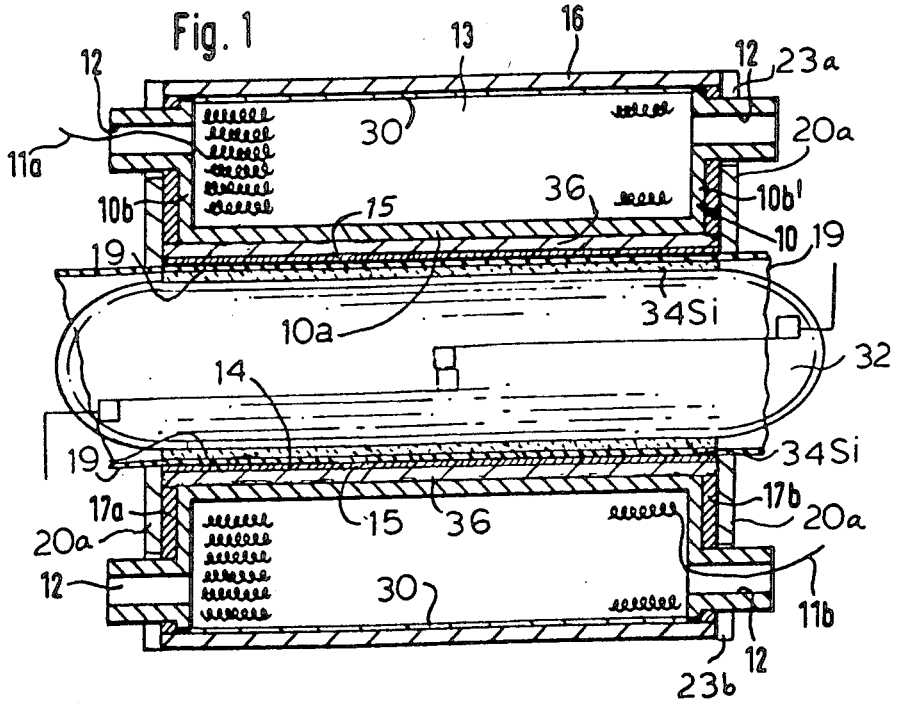
FIG. 1 shows a cross-section through the bobbin with the winding indicated schematically, both parts being sealed hermetically in a metallic enclosure.

The fundamental production method therefore starts by winding the coil upon the bobbin, which is designated by the numeral 10 in FIG. 1 and comprises a central tube portion 10*a* and flanges 10*b*, 10*b'* arranged on both sides thereof, the beginning and the end of the coil being passed, as indicated at 11*a* and 11*b*, through tube-shaped holes 12 in the flanges 10*b*, 10*b'*. In the representation of FIG. 1, the coil wound upon the bobbin 10 is indicated schematically only and designated by reference numeral 13.

The finished "coil" is then fully enclosed by a low-ohmic shielding which is achieved by introducing into the inner annular opening 14 of the bobbin 10 a first metallic tube 15 consisting—just as the other shielding parts—preferably of brass and providing the necessary r.f. shielding together with the other parts which will be mentioned hereafter.

Advantageously, the assembly is supplemented by an additional magnetic shielding for the coil consisting of mu metal, preferably in the form of a foil 30 which may be wrapped around the coil in overlapping arrangement and which collects the magnetic field forming when the coil is activated and ensures at the same time that neighboring relays will not influence each other. The mu metal foil consists of a material which is particularly permeable magnetically.

Further, an outer tube 16 is placed on the bobbin and the winding so as to enclose the complete bobbin with winding, the length of the two tubes 15 and 16 being selected in such a manner that—in a preferred embodiment of the invention—they extend on both ends by a pre-determined length beyond the longitudinal extension of the bobbin so that the shielding of the coil can be completed by fitting so-called annular end disks 17*a*, 17*b* on both ends. The annular end disks consist preferably of punched rings of the shape shown in the top view of FIG. 4 and are provided near their periphery with two diametrically opposite lead-through openings 18 through which the annular projections provided on the coil flanges and forming the tube-shaped holes 12 can be passed.

In the embodiment shown in FIG. 1, the inner dimensions of the bore and the outer dimensions of the ring of the two annular ring disks which may be formed preferably by punched rings are selected in such a manner that preferably the ring is slightly oversized which means that the inner bore of each punched disk is a little smaller than the diameter of the inner tube 15 while the outer diameter of each annular end disk is, preferably, a little larger than the inner diameter of the outer tube 16.

This permits the four brass parts 15, 16, 17*a*, 17*b* to be joined intimately to form a very low-ohmic structure within which the bobbin and the coil are sealed hermetically.

Preferably, this is achieved by fire-tinning the four brass parts used for this purpose and joining them under pressure in a suitable tool, whereby the two annular end disks are pressed into the outer tube while the inner tube is simultaneously pressed into the central opening of the annular end disks. During this pressing operation, a certain slight deformation of the parts may occur which ensures a strong, form and friction-locking connection between all shielding parts.

It goes, however, without saying that the described shielding may be realized in other ways, too. For example, the annular end disks may be cap-shaped and fitted by their inwardly directed annular flanges on the outer tube 16, while inner annular flanges projecting from the inner bore of the annular end faces are pressed into the inner tube 15. This example shows that this point—i.e. the connection of the individual brass shielding parts—gives room for still other possible solutions.

Thereafter, the coil and bobbin, wrapped in this manner in the low-ohmic metallic shielding, are connected with the bobbin carrier which is shown in FIGS. 2*a* to 2*d* and 3*a* and 3*b* and which is built up as follows:

The first part of a bobbin carrier 18*a* shown in FIGS. 2*a* and 2*d*—the second part according to FIGS. 3*a* and 3*b* is designated by reference numeral 18*b*—comprises a hollow longitudinal tube 19 which is intended to be introduced, preferably flush, into the bobbin/coil/-shielding assembly until it comes to rest against a bearing flange 20 preferably formed integrally with the tube 19. The first part of the bobbin carrier 18*a* is made preferably of a suitable plastic material, such as polypropylene, for example the one known as Vestolen, and the carrier tube 19 and the bearing flange 20 at its end are formed in one piece, the carrier tube 19 passing through a vertical wall 20*a* of the bearing flange 20 and being connected, via central reinforcing ribs 21, with the said wall 20*a* and a foot plate 20*b* extending vertically from the wall 20*a* thereby giving the carrier flange 20 the shape of an L. The two legs of the L shape may be additionally connected by lateral triangular ribs 22 providing additional strength to the structure.

As can be seen best from the representation of FIG. 2*c*, the wall 20*a* of the bearing flange 20 is provided with lateral slots 23*a*, 23*b* receiving on both sides the projecting tube-shaped projections 12 of the bobbin which extend beyond the outer dimensions of the shielding even after the bobbin has been "wrapped" into the shielding material. One obtains in this manner simultaneously a firm seat and anchoring for the bobbin/coil assembly and the shielding at the bobbin carrier 18, it being self-evident that after this assembly has been mounted on the carrier tube 19, the bobbin carrier structure and, thus, the whole structure of the r.f. reed relay are completed by the second bearing flange 20' which is represented in FIGS. 3*a* and 3*b* and which is fitted upon the bearing tube 19 projecting to the right, as viewed in FIGS. 2*a* to 2*d*. The latter comprises, accordingly, in addition to the base plate 20*b'* and the vertical wall 20*a'* a tube-shaped projection 24 extending outwardly and intended for being fitted upon the bearing tube 19 so that a safe connection, fixed against rotation, is achieved with the first part 18*a* of the bobbin carrier 18 and a form-locking connection is provided—again in the form of lateral mounting slots 23*a'*, 23*b'*—for the bobbin with its tube-shaped projections 12.

In the fully assembled condition, the bearing tube 19 projects beyond the bearing flanges 20*a*, 20*b* of the bobbin carrier 18 by approximately the length shown in FIGS. 2*a*, 2*b*. These figures also show the reed relay in real size, after the bobbin/coil/shielding assembly and the second flange part have been mounted.

The reed relay is then completed by introducing into the interior of the bearing tube 19 and fixing therein a special high-tension switch 32 which is produced separately in a manner that need not be discussed here as a vacuum glass tube with contact paddles sealed therein on both sides. Fixing may be effected, for example, by (silicon) hose pieces 34 fitted on both sides tightly around the glass tube of the reed switch which are pressed into the bearing tube 19. It is, however, also possible to enclose the vacuum glass tube fully in a silicon hose and to introduce the unit as a whole into the bearing tube 19.

Prior to introducing the glass tube of the reed switch, the coil ends may be soldered to coil connecting pins (not shown in the drawing) provided on the two bearing flanges 20, 20'.

The invention also provides the possibility to design such an r.f./high-tension reed relay as a break relay, without changing the basic concept of the invention, by arranging in addition a magnet—preferably an annular magnet 36—in the bobbin/coil/shielding assembly. To this end, the inner diameter of the bobbin 10 shown in FIG. 1 may be somewhat enlarged to provide room for the annular magnet. Of course, the inner brass tube 15 must then be introduced in such a manner that the annular magnet completing the break relay is also shielded from the r.f. field, i.e. located within the shielding.

An r.f. reed relay of the design described above has the technical data set forth hereafter, it being understood, however, that these data do not in any way restrict the invention, but are only meant to supplement the description of one embodiment thereof.

| | |
|---|---|
| Frequency range | 1.5 . . . 30 MHz |
| Max. operating voltage $U_{peak}$ | 5 kV |
| Testing d.c. voltage | |
| Contact - contact | 10 kV, 1 min. |
| Contact - coil | 10 kV, 1 min. |
| Shielding - coil | 500 V, 1 min. |
| Max. operating current (permanent current) | 5 $A_{eff}$ |
| Capacitance | |
| Contact - contact | 0.5 pF |
| Contact - coil, beginning | 1.1 pF |
| Contact - coil, end | 1.1 pF |
| Contact - coil (contact closed) | 1.8 pF |
| Excitation data | |
| Operating voltage | +24 V ± 1 V |
| Pick-up voltage | 15 V at 25° C. |
| Releasing voltage | 3 V at 25° C. |
| Pick-up time/rebounding time | 3/0.5 ms |
| Releasing time/rebounding time | 0.3/0.1 ms |
| Winding data | |
| Cu-L Wire | 0.075 mm dia. V 170 |
| Number of windings | approx. 8000 |
| Coil resistance | 1300 Ohms ± 10% |

Measurements performed on such a reed relay have shown that during operation of the relay at 30 MHz and 5 $A_{eff}$ the coil heats up maximally by 30 Kelvin.

All features mentioned or shown in the above description, the following claims and the drawing may be essential to the invention either alone or in any combination thereof.

I claim:

1. A reed relay for switching r.f. signals wherein a coil is wound about a bobbin which encloses a pair of contacts sealed in a vacuum within a glass tube; characterized in that a bobbin is provided; a coil wound on said bobbin; a low-ohmic magnetically non-conducting metallic shield assembly comprising an inner tube, an outer tube and annular end disks encasing said bobbin; connecting means electrically connecting together said tubes and said end disks; and a bobbin carrier supporting said bobbin thereon.

2. A reed relay according to claim 1, characterized in that the inner tube, the outer tube and the end disks are connected by a solder connection.

3. A reed relay according to claim 1, characterized in that said inner tube, outer tube and annular end disks are connected by a press fit.

4. A reed relay according to claim 1, characterized in that the bobbin comprises a central tube carrying the winding, and having two end flanges; and tube-shaped projections on said end flanges providing respective passages through which the ends of the coil extend.

5. A reed relay as in claim 4, in which said bobbin carrier includes end walls having respective recesses therein receiving said tube-shaped projections to prevent rotation of said bobbin relative to said bobbin carrier.

6. A reed relay according to claim 1, in which said bobbin carrier comprises a bearing flange and a bearing tube projecting therefrom and integrally formed therewith, said bearing tube extending through said bobbin, and a second bearing flange mounted on said bearing tube opposite the other bearing flange.

7. A reed relay according to claim 6, in which said bearing flanges are L-shaped in cross section, each of said bearing flanges comprising a wall adjacent said bobbin and a bearing plate extending transversely thereto, and reinforcing ribs connecting said wall with said bearing plate.

8. A reed relay as in claim 6, in which said second bearing flange includes a tube-shaped extension receiving said bearing tube therethrough.

9. A reed relay according to claim 1, in which said inner and outer tubes and said annular end disks are fabricated from fire-tinned brass, and said bobbin and bobbin carrier are fabricated from a plastic material.

10. A reed relay in accordance with claim 1, and a break contact in said switch, and an annular magnet between said coil and said inner tube.

11. A reed relay in accordance with claim 10, in which said annular magnet comprises an alloyed magnet.

12. A reed relay in accordance with claim 1, and a winding of magnetically highly conductive material on said coil.

13. A reed relay as in claim 12, characterized in that the magnetically highly conductive winding comprises an overlapping wrapping of $\mu$ metal foil.

14. A method for producing a reed relay for switching r.f. signals wherein the coil is wound about a bobbin which encloses a pair of contacts sealed in a vacuum within a glass tube, characterized in that the method includes:

(a) winding the coil about a bobbin;
(b) encasing the bobbin in a low-ohmic magnetically nonconducting metallic shield comprising an inner tube, an outer tube and annular end disks;
(c) electrically connecting together the inner and outer tubes and end disks;
(d) mounting the bobbin on a bobbin carrier; and
(e) inserting the vacuum switch into the bobbin carrier.

15. The method according to claim 14, characterized in that the metallic shielding parts are joined in a friction-locking manner by a pressing operation, the parts being assembled by first introducing the inner tube into the bobbin, mounting the outer tube thereon, and connecting the two metallic annular end disks thereto.

16. The method according to claim 14, characterized in that the annular end disks are provided as punched rings and pressed onto the outer tube and the inner tube is received in a central opening in the annular end disks, said shield being fabricated from brass, and fire-tinning said inner and outer tubes and said annular end disks before joining the same.

17. The method of claim 14, characterized in that the bobbin is mounted on the bobbin carrier by mounting the bobbin on a bearing tube and positioning at least an end piece on the bearing tube.

18. The method according to claim 17, wherein the end disks are provided with tube-shaped projections, and the bobbin carrier includes end flanges having holes therein characterized in that the tube-shaped projections are received in the corresponding holes in the flanges when the bobbin is mounted on said bobbin carrier thereby to prevent rotation of the bobbin with respect to the bobbin carrier.

19. The method according to claim 14, wherein the carrier support includes a bearing tube that extends through the bobbin, characterized in that the vacuum switch is inserted into and connected to the bearing tube of the bobbin carrier by a silicon hose surrounding said vacuum switch.

* * * * *